US011097893B2

(12) United States Patent
Roman

(10) Patent No.: US 11,097,893 B2
(45) Date of Patent: Aug. 24, 2021

(54) U-SHAPED LOCK TOOL

(71) Applicant: Artemio Roman, Houston, TX (US)

(72) Inventor: Artemio Roman, Houston, TX (US)

( * ) Notice: Subject to any disclaimer, the term of this patent is extended or adjusted under 35 U.S.C. 154(b) by 0 days.

(21) Appl. No.: 16/512,360

(22) Filed: Jul. 15, 2019

(65) Prior Publication Data

US 2020/0115153 A1 Apr. 16, 2020

Related U.S. Application Data

(60) Provisional application No. 62/697,592, filed on Jul. 13, 2018.

(51) Int. Cl.
*B65D 90/00* (2006.01)
*B65D 88/12* (2006.01)

(52) U.S. Cl.
CPC ..... *B65D 90/002* (2013.01); *B65D 88/121* (2013.01)

(58) Field of Classification Search
CPC ..... B65D 90/0053; B65D 19/08; B65D 2519/00298; B65D 2519/00338; B65D 2519/00532; B65D 2519/00626
USPC ..... 410/143, 151, 144, 150, 152, 87, 7, 44, 410/42, 40; 248/354.1, 125.2, 122.1, 248/125.8, 157, 503, 251
See application file for complete search history.

(56) References Cited

U.S. PATENT DOCUMENTS 1,941,214 A * 12/1933 Kusterle ..... A47C 20/042 74/547
4,123,882 A * 11/1978 Case ..... B66C 1/666 294/15
5,390,970 A 2/1995 Gray
5,549,347 A * 8/1996 Anderson ..... B60J 7/085 160/243
5,566,998 A * 10/1996 Gray ..... B65D 90/0013 294/15
7,878,743 B2 * 2/2011 Aftanas ..... B60P 7/0815 410/150
8,172,494 B1 * 5/2012 Knox ..... B60P 1/00 410/89
8,757,321 B2 6/2014 Patterson
2017/0044791 A1 2/2017 Nelson
2017/0334061 A1 11/2017 Gallup et al.

FOREIGN PATENT DOCUMENTS

WO 2016090402 6/2016

* cited by examiner

*Primary Examiner* — D Glenn Dayoan
*Assistant Examiner* — Sunsurraye Westbrook
(74) *Attorney, Agent, or Firm* — Delphine James

(57) ABSTRACT

A tool for securing a shipping container head with two extensions extending away from the head and having a space between them sufficient to accommodate a bar bracket of a container lashing turnbuckles used to secure a shipping container door. The head also has a handle that can function as a lever, so that when the tool engages the turnbuckle bar bracket, an operator can close and secure the shipping container door.

9 Claims, 5 Drawing Sheets

Fig. 2
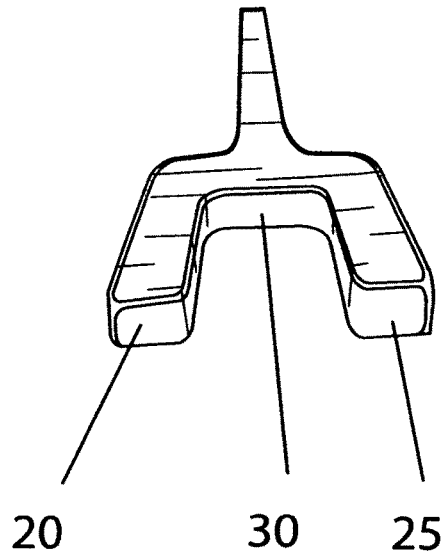
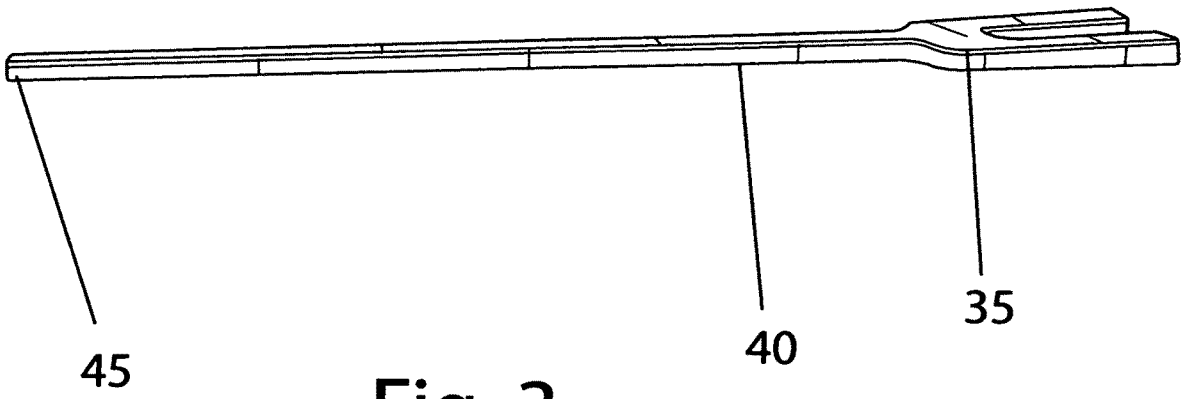
Fig. 3

U-SHAPED LOCK TOOL

This application claims the benefit of application 62/697,592.

BACKGROUND

The present invention relates to tools useful for securing shipping containers.

Intermodal shipping containers are used throughout the world. Transporting everything from bulk raw materials to refined goods, millions of shipping containers move each day. The intermodal container is a large standardized shipping container, used in intermodal freight transport. The intermodal container can be 40 foot long with each of the eight corners adapted with a twist lock fitting for hoisting, stacking, and securing. Thus, making the containers stackable for loading and transport on large ships feasible and efficient.

Intermodal freight transport involves the transportation of freight in an intermodal container using multiple modes of transportation (e.g., rail, ship, and truck), without any handling of the freight itself when changing modes. The method reduces cargo handling, and improves security, reduces damage and loss, and allows freight to be transported faster. Reduced costs over road trucking are the key benefit for intercontinental use. The applicant has developed a tool to assist in the securing and removal of the intermodal container during transport and storage. Applicant has discovered a new and improved means for closing and securing the doors of intermodal shipping containers that are secured with turnbuckles.

SUMMARY OF THE INVENTION

One of the major objectives of this invention is to provide a tool that can help secure and unsecure shipping containers.

Some embodiments of the present invention provide tools for securing a shipping container door, comprising;

a head that comprises a front face and a rear face that together define a top edge;

two extension proximal to the top edge extending from the front face;

a handle extending from the head a length enough to provide leverage laterally downward while securing the turnbuckle.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

BRIEF DESCRIPTION OF DRAWINGS

These and other details of the present invention will be described in connection with the accompany drawings, which are not furnished only by way of illustration and not in limitation of the invention.

FIG. 2 depicts the tool in a back-side perspective view

FIG. 3 depicts the tool in a side-view perspective

DETAILED DESCRIPTION OF THE INVENTION

Hereinafter, an embodiment of the present invention will be described in detail with reference to the accompanying drawings. However, the present invention is not limited to the embodiment to be described below but may be implemented in various embodiments of the U-shaped locking tool device. The embodiment is merely provided to completely disclose the present invention and completely inform those skilled in the art of the spirit of the present invention.

With reference now to the drawings, the u-shaped tool is used to secure containers above deck on a container ship or barge to keep containers from falling. One end of the turnbuckle is attached to either a short or long lashing bar which in turn is connected to a container corner casting as depicted in FIGS. 5 and 6.

Figure 1:
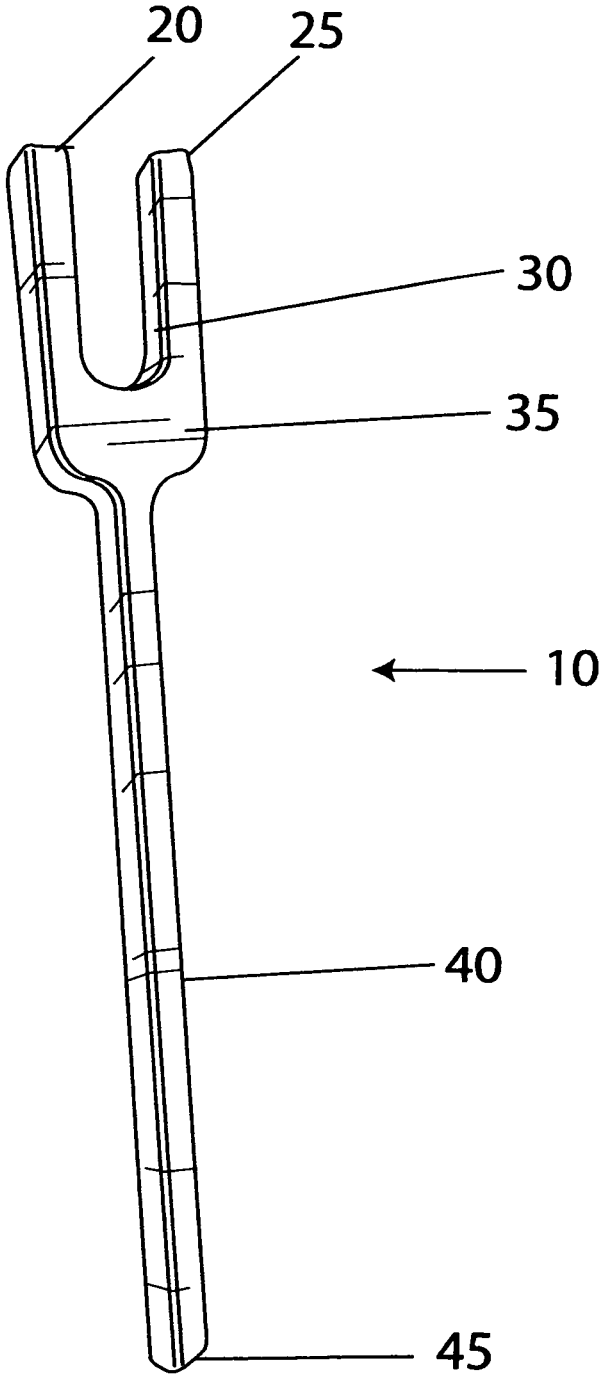
FIG. 1 depicts, in a front-view perspective

Referring to FIG. 1, the tool has a head (35) comprising a front face and a rear face that together define a top edge from which two extensions laterally extend. The two extensions (20, 25) defines a curved arc (30) between the front face and the rear face that extends from the top edge. The tool also has a handle (40) of sufficient length to provide leverage during securing of the turnbuckle.

As shown in FIGS. 1-3, the tool handle (40) can have a length of at least 2 feet 1 inch and at least 1 inch thick. The opposing extensions can be at least 2 feet 8 inches long. The opposing extensions (20, 25) can be spread apart at least 5 inches.

Figure 4:
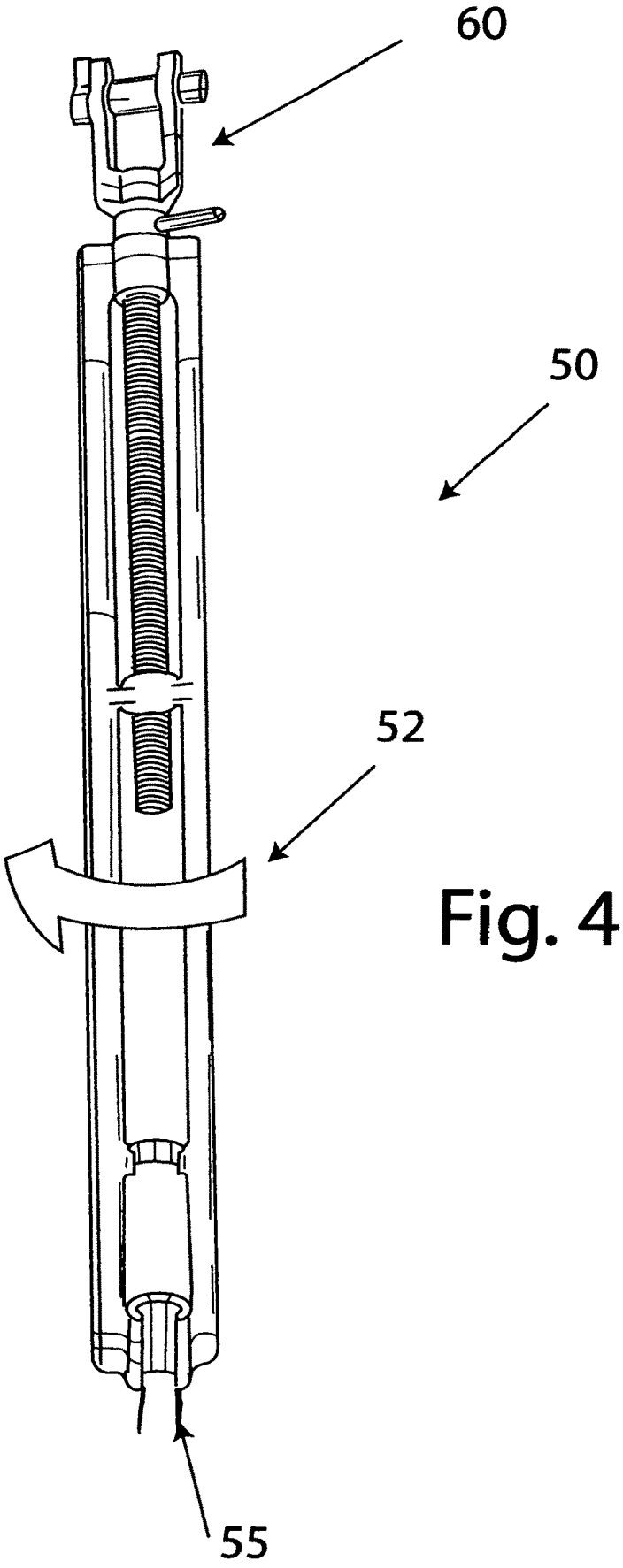
FIG. 4 depicts the turnbuckle
Figure 5:
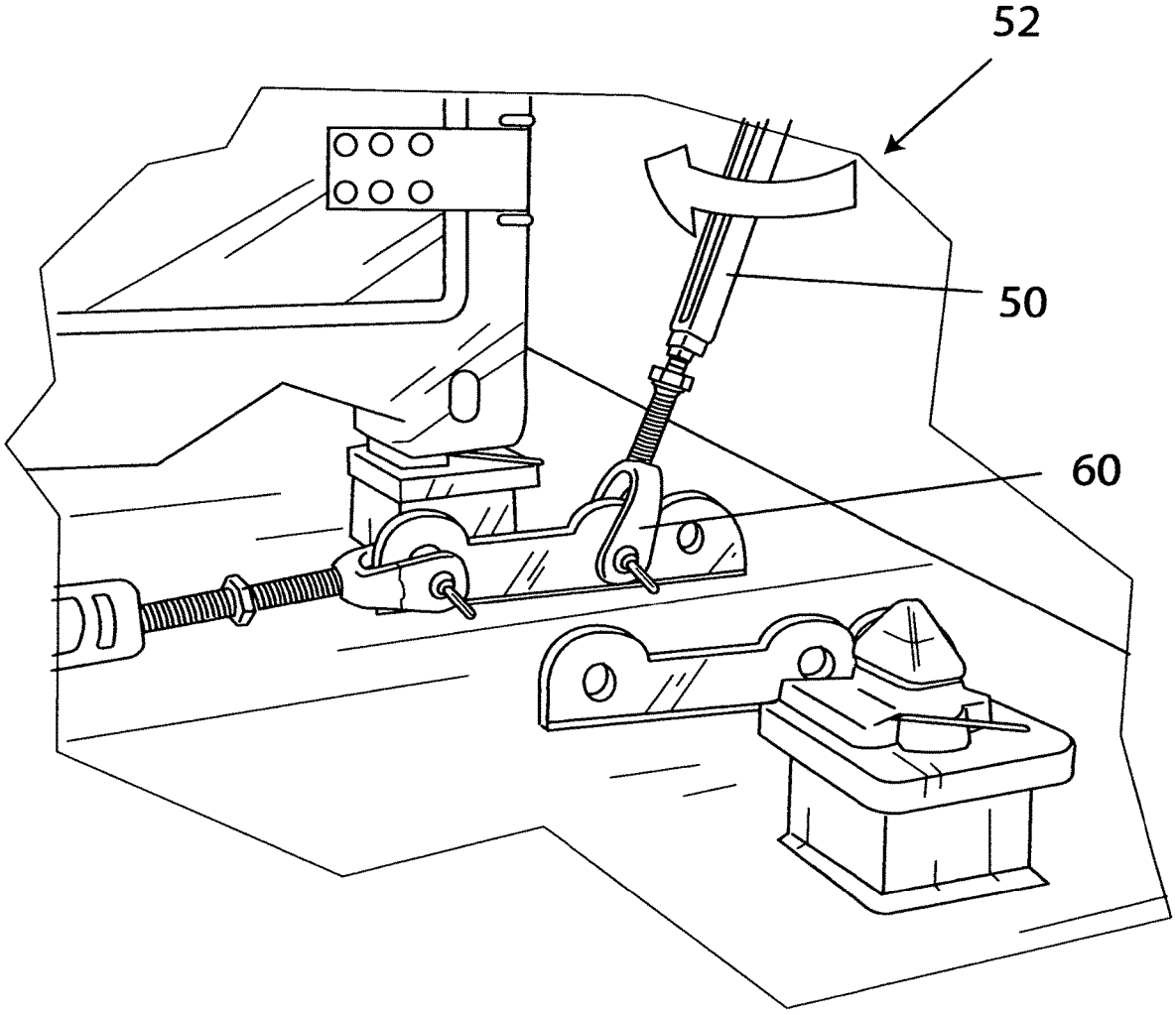
FIG. 5 depicts the turnbuckle attached to ships
Figure 6:
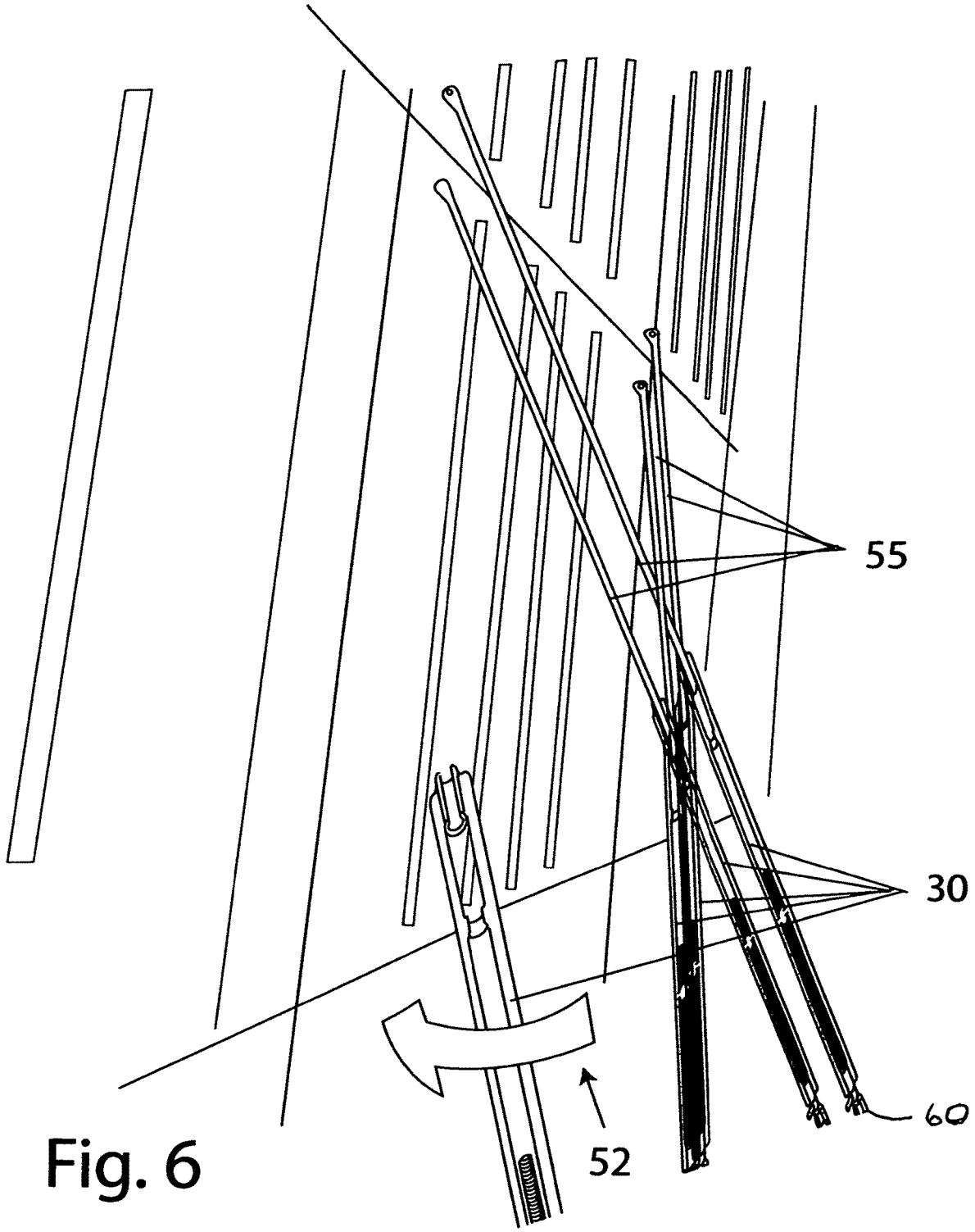
FIG. 6 depicts the turnbuckle attached to freight containers.

As shown in FIG. 4 container turnbuckles (50) are used in combination with lashing bars (55) to secure containers above deck on a container ship or barge as shown in FIGS. 5 and 6. The jaw end of the turnbuckle (60) is secured to a D ring or lashing plate which is welded to the ships deck as shown in FIG. 5. The other end of the turnbuckle (55) is attached to either a short or long lashing bar (56) which in turn is connected to a container corner casting. Long lashing bars, about 4500 to 5000 mm long are for use with the bottom fittings on the third container tier. Short lashing bars, about 2500 mm long are for insertion into the corner casting at the bottom of the second tier of containers.

Turnbuckles have a maximum and minimum opening length. If you turn the bars of the turnbuckle (50) they will tighten or loosen depending on the direction turned. During container use, you want the turnbuckle to have all slack taken out of the system, but you do not want the fitting to be too tight.

In use, the bar bracket of the turnbuckle is placed between the arc of the opposing extension. Then, leverage is placed upon the handle which causes turnbuckle (50) to rotate in the direction of arrow (52) or in the opposite direction of arrow (52) thereby respectively increasing or decreasing desired tension.

What is claimed is:

1. A locking tool device to use in conjunction with a turnbuckle having one end that is attached to a freight shipping container, the device comprising:

a head comprising a planar front face and a planar rear face that together define a top edge from which a pair of opposing extensions laterally extend;

a handle centrally attached to a peripheral of the head and extending linearly therefrom;

the turnbuckle having a bar bracket disposed between opposing ends;

the pair of opposing extensions define a curved arc between the planar front face and the planar rear face that extends from the top edge;

the locking tool being made of a hard, sturdy, non-flexible material;

the handle having a predetermined length and predetermined depth; and the curved arc having a predetermined diameter and predetermined circumference to engage and surround the bar bracket wherein the turnbuckle is rotated clockwise or counterclockwise.

2. The device of claim 1 wherein the pre-determined length of the handle is at least at least 2 feet long.

3. The device of claim 1 wherein the pre-determined depth of the handle is at least one inch thick.

4. The device of claim 1 wherein the pre-determined diameter of the arc of the opposing extensions is at least five inches long.

5. The device of claim 1 wherein the pre-determined length of the opposing extensions are at least two feet.

6. The device of claim 1 wherein the pre-determined circumference of arc is at least four feet.

7. The device of claim 1 wherein the locking tool is made of steel.

8. A method of securing a turnbuckle attached to a freight container, the method comprising:

providing the locking device tool of claim 1;

the turnbuckle having one end securely attached to a D-Ring or a lashing plate which is welded to the ship floor;

the turnbuckle having a bar bracket sandwiched between opposing ends;

placing the bar bracket between the arc of the opposing extensions;

placing leverage on the handle which causes the turnbuckle to turn.

9. The method of claim 8 further comprising rotating the turnbuckle clockwise to increase or decrease tension.

* * * * *